US006257995B1

(12) United States Patent
Schrimmer et al.

(10) Patent No.: US 6,257,995 B1
(45) Date of Patent: Jul. 10, 2001

(54) ILLUMINATED GOLF BALL

(75) Inventors: Michael L. Schrimmer, Wheeling, IL (US); Thomas Musial, Pompano Beach, FL (US)

(73) Assignee: Chemical Light, Inc., Vernon Hills, IL (US)

( * ) Notice: Subject to any disclaimer, the term of this patent is extended or adjusted under 35 U.S.C. 154(b) by 0 days.

(21) Appl. No.: 09/479,857

(22) Filed: Jan. 7, 2000

(Under 37 CFR 1.47)

Related U.S. Application Data

(62) Division of application No. 09/086,393, filed on May 28, 1998, now Pat. No. 6,042,487.

(51) Int. Cl.[7] ..... A63B 69/36
(52) U.S. Cl. ..... 473/353
(58) Field of Search ..... 473/353, 570

(56) References Cited

U.S. PATENT DOCUMENTS

| | | | | |
|---|---|---|---|---|
| 2,020,484 | | 11/1935 | Turner . | |
| 3,351,347 | | 11/1967 | Smith et al. . | |
| 3,458,205 | * | 7/1969 | Smith et al. | 473/353 |
| 3,580,575 | | 5/1971 | Speeth . | |
| 3,804,411 | | 4/1974 | Hendry . | |
| 4,695,055 | | 9/1987 | Newcomb et al. . | |
| 4,701,146 | | 10/1987 | Swenson . | |
| 4,776,589 | | 10/1988 | Yang . | |
| 4,878,674 | | 11/1989 | Newcomb et al. . | |
| 4,968,036 | | 11/1990 | Von Der Mark . | |
| 4,991,851 | | 2/1991 | Melesio . | |
| 5,066,011 | | 11/1991 | Dykstra et al. . | |
| 5,102,131 | | 4/1992 | Remington et al. . | |
| 5,228,686 | | 7/1993 | Maleyko . | |
| 5,228,697 | | 7/1993 | Gulick et al. . | |
| 5,236,383 | | 8/1993 | Connelly . | |
| 5,330,195 | | 7/1994 | Gulick . | |
| 5,388,825 | | 2/1995 | Myers et al. . | |
| 5,445,373 | | 8/1995 | Franks . | |
| 5,490,047 | | 2/1996 | O'Rourke et al. . | |
| 5,653,640 | | 8/1997 | Shirley, Jr. . | |
| 5,762,573 | | 6/1998 | Kennedy, III et al. . | |
| 5,779,574 | | 7/1998 | Allman et al. . | |
| 6,042,487 | * | 3/2000 | Schrimmer et al. | 473/353 |

* cited by examiner

*Primary Examiner*—Mark S. Graham
*Assistant Examiner*—Raeann Gorden
(74) *Attorney, Agent, or Firm*—Welsh & Katz, Ltd.; Mitchell J. Weinstein

(57) ABSTRACT

An illuminatable golf ball includes an outer translucent shell and an inner core portion surrounded by the outer shell. The ball includes a self-contained lighting device formed and contained at least in part within the inner core portion. The lighting device includes an energy source, a pair of lighting elements, and connectors extending between the energy source and the lighting elements defining an electrical circuit. The lighting device includes a switch for energizing and deenergizing the lighting device. The switch can include a plunger insertable into the ball through an opening in the outer shell and through a bore in the inner core portion. The plunger is configured to change the state of the electrical circuit when it is inserted into and removed from the bore to energize and deenergize the lighting elements. The switch can also be of the force actuatable type.

15 Claims, 3 Drawing Sheets

FIG. 1
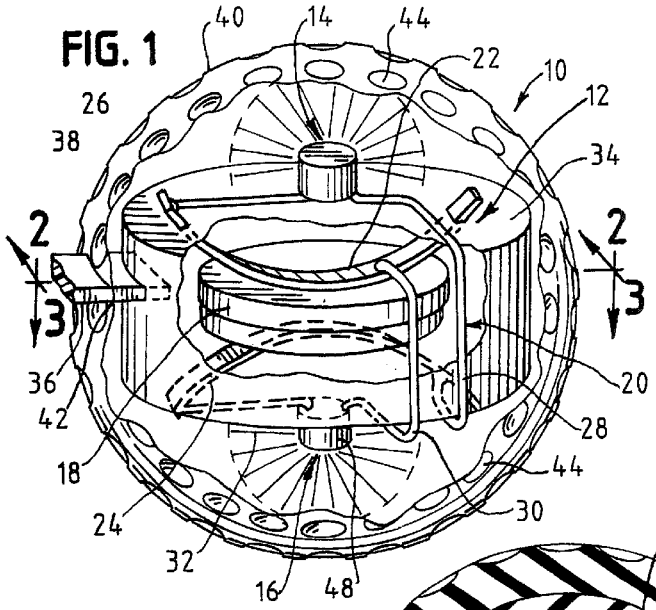
FIG. 4
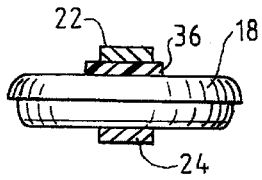
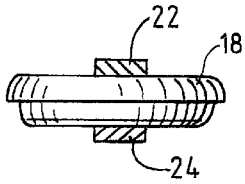
FIG. 5
FIG. 2
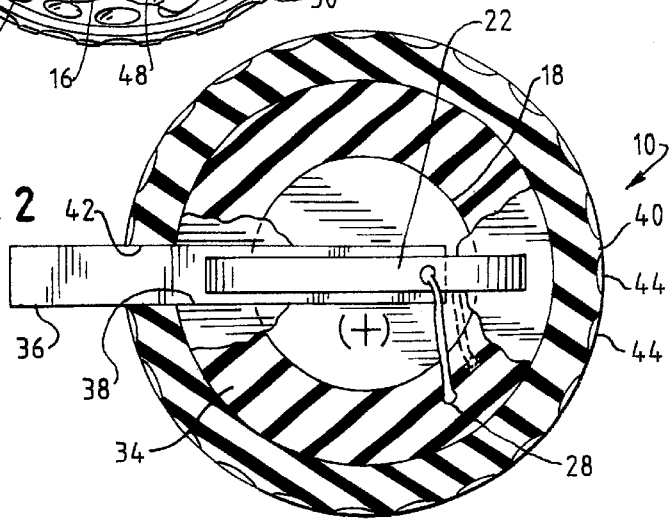
FIG. 3
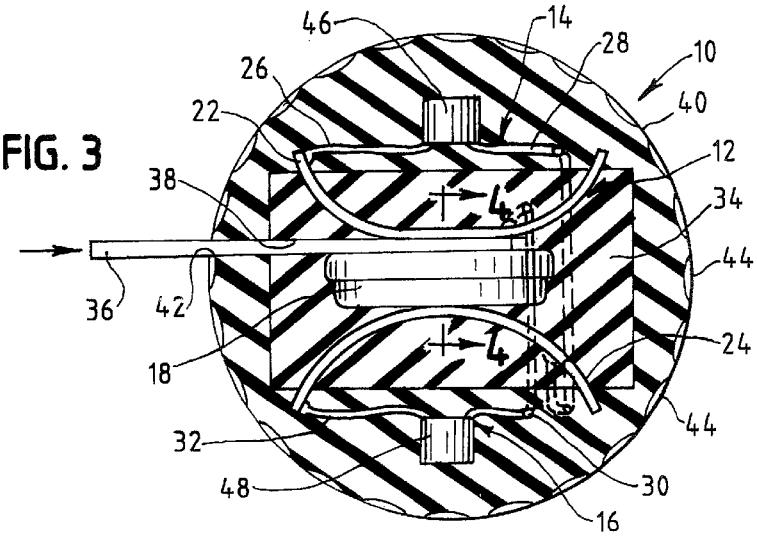

ILLUMINATED GOLF BALL

This application is a division of Ser. No. 09/086,393 is now U.S. Pat. No. 6,042,487 filed on May 28, 1998.

FIELD OF THE INVENTION

This invention pertains to an illuminated golf ball, more particularly, the invention pertains to an illuminatable golf ball having an impact-resistant lighting device therein and a translucent cover for providing visible indication of the golf ball location.

BACKGROUND OF THE INVENTION

Golf has become a tremendously popular game, not just in the United States, but worldwide. The game has become so popular that it is often difficult to secure "tee" times at sufficiently reasonable hours to be able to play through nine or eighteen holes while still playing in daylight.

Because golf courses often have holes that average 300 to 400 yards in length and cover large areas, it is difficult, if not impossible, to illuminate an entire course to permit play at night. As such, golf is a particularly limited daytime game. Some "pitch and putt" courses may be sufficiently illuminated to permit play in the evening, however, most individuals that play the game of golf would, of course, prefer to play a standard length course.

Attempts have been made to provide golf balls that are sufficiently visible in the dark to permit evening play. However, such golf balls are typically coated with luminous paints, or include chemiluminescent lighting devices, and do not provide a sufficiently long period of bright or strong luminescence to permit play of an entire round of evening golf. One known device includes a chemiluminescent light stick that is inserted into an opening in the ball. When the light stick is activated, it emits a low luminescent light that is visible for a limited period of time. Such chemiluminescent golf balls may include a translucent outer skin or coating to permit a wider range of view of light emitted from the ball. However, those who have had occasion to use a chemiluminescent light sticks will recognize that such sticks often lose their ability to emit a relatively bright light in a short period of time. Moreover, such liquid chemiluminescent light stick inserts can affect the weight and balance of the ball, and thus the flight of the ball.

Another glow-in-the-dark golf ball includes a phosphorescent or luminescent glowing element that is molded within the center of the ball. The ball includes a translucent or transparent outer cover that permits the internal luminescent element to be viewed through the outer covering of the ball. However, these golf balls suffer from the same drawbacks as those that include chemiluminescent light sticks.

Game balls having lights installed therein are known in the art. However, as will be recognized by those skilled in the art and by those that play the game of golf, golf balls are subject to tremendously high impact forces during play. As such, while attempts have been made to create golf balls that will provide a sufficient amount of light such that they can be seen along a fairway in the evening, such attempts have fallen short of creating a golf ball that can withstand the tremendous impact forces and still retain the lighting device or lighting element in condition to emit light.

Accordingly, there continues to be a need for an illuminated golf ball that emits sufficient light to permit locating the ball along a fairway at night, which ball withstands the severe impact forces and other environmental conditions to which the ball may be subjected.

SUMMARY OF THE INVENTION

An illuminatable golf ball includes an outer translucent shell and an inner core portion surrounded by the outer shell. The inner core portion supports a self-contained lighting device. In one embodiment, the inner core portion has a bore therein that is in alignment with an opening in the outer shell.

The lighting device is formed within the inner core portion. The lighting device includes an energy source, such as a battery, and at least one and preferably two lighting elements. In an externally actuatable embodiment, the lighting device includes connectors, at least one of which is flexible, extending between the energy source and the lighting elements. The energy source lighting elements and connectors define an electrical circuit having a deenergized state and an energized state for providing electrical energy from the energy source to the lighting devices.

The flexible connector is separable from the energy source such that the electrical circuit is switchable between the energized state to illuminate the lighting devices and the deenergized state to open the circuit and thus deenergize the lighting devices.

In one embodiment of the externally actuatable embodiment, the ball includes a plunger that is at least in part non-conductive. The plunger is insertable into the ball through the opening in the outer shell and through the bore in the inner core portion. When inserted into the ball, the plunger interrupts the circuit by separating the at least one flexible connector from the battery terminal, thereby opening the circuit and consequently deenergizing the lighting elements.

In a preferred embodiment the energy source is a battery, and most preferably a button-type battery. In a present embodiment, the ball includes two lighting elements that are light emitting diodes (LEDs) connected in the electrical circuit in parallel. Thus, if one of the lighting elements fails, the other lighting element will light.

Preferably, the inner core portion is formed of polyurethane and surrounds essentially the entirety of the lighting device except for the light emitting portions of the LEDs. In a most preferred embodiment, the outer shell portion is formed of a cut-resistant, non-abrasive polyurethane material. Preferably, the polyurethane outer shell is formed with dimples therein such that the ball resembles a traditional golf ball.

An alternate embodiment of the externally actuatable golf ball includes a plunger that is at least in part electrically conductive, that, when inserted into the golf ball completes the electrical circuit to energize the lighting elements. In this embodiment, one of the flexible connectors is positioned in spaced relation to the battery thus establishing an open circuit, and inserting the plunger into the ball completes or closes the circuit.

Still another embodiment of the illuminated golf ball includes a lighting device that is actuatable by includes a switch that is actuatable by a force applied to the switch. Preferably, the lighting device includes a timer that deenergizes the lighting element after a predetermined time of actuation. In this embodiment the ball is fully sealed.

Advantageously, the present illuminatable golf ball withstands the severe impact of a golf club head from, for example, a drive shot, while providing the "look-and-feel" of a traditional golf ball. In addition, the present golf ball is sufficiently impact resistant and environment resistive so that it will maintain its ability to light even when the ball is subjected to water such as from a water hazard.

Other features and advantages of the present invention will be apparent from the following detailed description, the accompanying drawings, and the appended claims.

BRIEF DESCRIPTION OF THE DRAWINGS

FIG. 1 is a partially broken away perspective view of one embodiment of an externally actuatable illuminated golf ball in accordance with the present invention, the ball being illustrated, in part, with the plunger inserted therein for clarity of illustration;

FIG. 2 is a cross-sectional view of the golf ball of FIG. 1 taken along line 2—2 of FIG. 1, with the plunger being fully inserted into the ball;

FIG. 3 is a cross-sectional view taken along line 3—3 of FIG. 1;

FIG. 4 is a cross-sectional view taken along line 4—4 of FIG. 1, illustrating the battery and flexible connectors resting thereon, and being illustrated with the plunger in position to open the lighting circuit;

FIG. 5 is a cross-sectional view similar to FIG. 4 shown with the plunger removed from between the battery and the flexible connector to complete the lighting circuit;

DETAILED DESCRIPTION OF THE PREFERRED EMBODIMENTS

Figure 6:
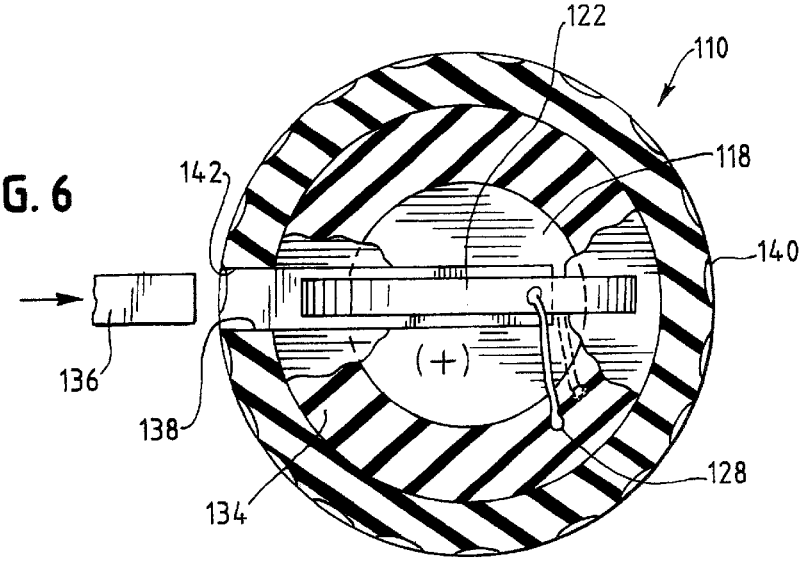
FIG. 6 is a cross-sectional view of an alternate embodiment of the externally actuatable illuminated golf ball, the view being similar to that of FIG. 2, showing the conductive plunger separate from the ball for clarity of illustration.
Figure 7:
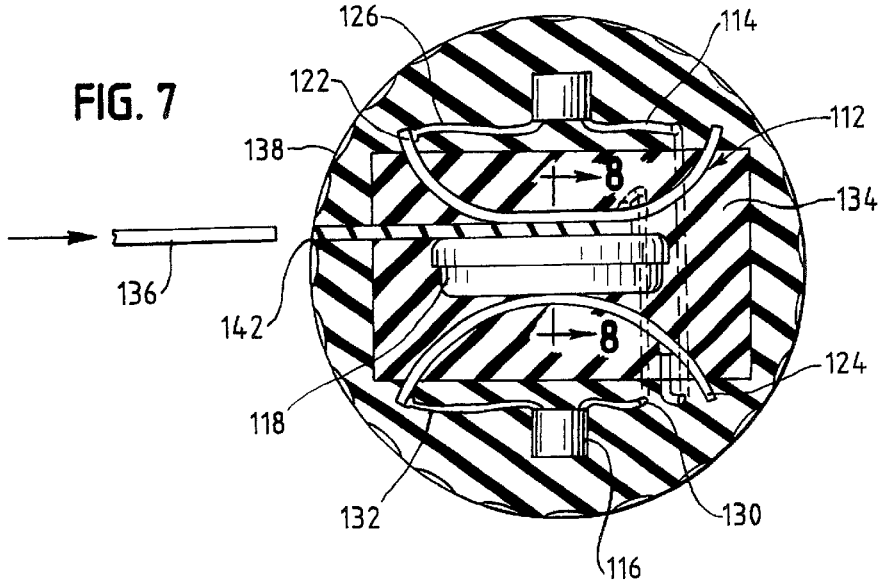
FIG. 7 is a cross-sectional view of the embodiment of FIG. 6, the view being similar to that of FIG. 3, showing the conductive plunger separate from the ball for clarity of illustration.
Figure 8:
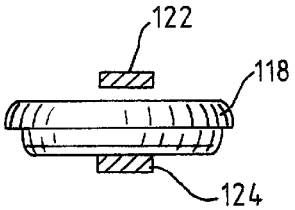
FIG. 8 is a cross-sectional view taken along line 8—8 of FIG. 7, illustrating the flexible connectors relative to the battery, with the plunger removed for clarity of illustration, and with the electrical circuit thus being in a deenergized state.
Figure 9:
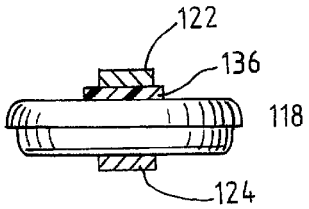
FIG. 9 is a cross-sectional view similar to FIG. 8 with the conductive plunger in place between and connecting the battery and the connector, with the electrical circuit thus being in an energized state.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures and in particular to FIG. 1, there is shown one embodiment of an externally actuatable illuminated golf ball 10 in accordance with the principles of the present invention. The ball 10 includes an electrical lighting device 12 therein. The lighting device 12 includes at least one, and preferably two lighting elements, such as the illustrated light emitting diodes 14, 16 (LEDs). The LEDs 14, 16 are lighted or energized by an energy source 18, such as a battery, positioned in the ball 10. As will be apparent from the drawings, the battery 18 can be of the common, button-type, used for watches and cameras, such as a 3-volt lithium cell battery. The battery 18 should be selected so as to provide sufficient voltage to illuminate the LEDs 14, 16 for a prolonged period of time.

Figure 10:
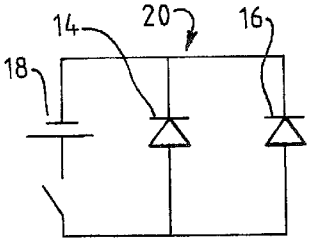
FIG. 10 is a simplified circuit diagram of the illuminating device of the golf ball of FIGS. 1–9.

The LEDs 14, 16 are part of an electrical circuit 20 (see FIG. 10) that is defined by the LEDs 14, 16, the energy source 18, a pair of flexible connectors 22, 24, as will be described in more detail herein, and other electrical connectors, such as wires or LED leads 26–32, extending between the LEDs 14, 16 and the flexible connectors 22, 24. It will be recognized by those skilled in the art that all of the connectors 22, 24 and wires 26–32 extending between the battery 18 and the LEDs 14, 16 must be of an electrically conductive material. The at least one and preferably both of the connectors 22, 24 are formed having an arcuate shape so that they maintain contact with the terminals of the battery 18.

As can be seen from FIGS. 1 and 3, the battery 18, flexible connectors 22, 24 and connections 26–32 between the LEDs 14, 16 and the flexible connectors 22, 24 are mounted within a non-conductive inner core portion 34 of the ball 10. The inner core portion 34 is formed so as to maintain all of the components therein in a generally fixed position relative to one another.

The ball 10 includes a plunger 36 that is insertable therein, that inserts between and separates one of the flexible connectors 22 from the battery 18. In a current embodiment, the plunger 36 inserts between one of the flexible connectors 22 and the positive terminal, or cathode (indicated by +) of the battery. In this manner, the plunger 36 essentially opens the circuit 20 to switch the circuit 20 into a deenergized state so that the lights 14, 16 are off. When the plunger 36 is removed from the ball 10, the flexible connector 22 contacts with the cathode +, thus closing the electrical circuit 20 and lighting the LEDs 14, 16.

The plunger 36 is insertable into the ball 10 through a bore 38 that is defined in the inner core portion 34. The inner core portion 34 can be formed from a wide variety of non-conductive materials. In a current embodiment, the inner core portion 34 is formed of a plastic or polymeric material, such as polyurethane, that is relatively easily molded around the components.

The ball 10 includes an outer translucent shell portion 40 enveloping the inner core portion 34 and enveloping the LEDs 14, 16. The outer shell 40 includes an opening 42 that is in alignment with the bore 38 in the inner core portion 34. The outer shell 40 is translucent to permit light from the LEDs 14, 16 to radiate therethrough, so that the light from the LEDs 14, 16 can be viewed from outside of the ball 10 when the circuit 20 is closed and the lights 14, 16 are energized. In a current embodiment, the outer shell 40 is formed of a clear polyurethane material that is abrasive and cut-resistant, which material can be formed with dimples 44 so that the outer shell 40 resembles the outer covering of a traditional golf ball. The particular formulation of polyurethane can be selected so that the material is translucent, and has high impact and cut resistance, while at the same time maintaining other characteristics of a golf ball, e.g. the "look and feel" of a traditional golf ball.

Although the electrical circuit 20 is relatively simple and straightforward, it will now be described with reference to a golf ball 10 having a pair of LEDs 14, 16, a pair of flexible connectors 22, 24, and a button-type battery 18, as illustrated in the figures. The LEDs 14, 16 each include two leads (26, 28 and 30, 32, respectively). A first lead 26 from the first LED 14 is connected to one of the flexible connectors 22 at about an end thereof. The other lead 28 from the LED 14 is connected to the opposing flexible connector 24 at or near the opposing end of the connector 24. The first and second leads 30, 32 from the other LED 16 are likewise connected to the first and second flexible connectors 22, 24. In this manner, each LED 14, 16 has a lead that is connected to each of the flexible connectors 22, 24. This arrangement provides LEDs 14, 16, that are essentially connected in parallel across the electrical circuit 20. Thus, if one of the LEDs, for example 14, was to fail, the other LED 16 would still be within a portion of the switchable circuit 20, and thus would still light.

Manufacture or formation of the golf ball 10 is straightforward. The components of the electrical lighting device 12 are first positioned relative to one another, with the flexible connectors 22, 24 resting on the battery terminals and the LED leads 26–32 connected to the flexible connectors 22, 24. The plunger 36 is then inserted within the electrical lighting device 12 between one of the flexible connectors 22 and one of the terminals of the battery 18, preferably the cathode (+). The inner core portion 34 is then formed around the electrical lighting device 12, leaving the light emitting portions 46, 48 of the LEDs 14, 16 outside of the inner core portion 34.

The inner core portion 34 is formed with the plunger 36 in place so that the flexible connector 22 has sufficient freedom to move into contact with the battery 18 (when the plunger is removed), and to move away and separate from the battery 18 (when the plunger is inserted) to open the circuit 20. The translucent outer shell 40 is then molded around the inner core portion 34, again with the plunger 36 in place, so that the opening 42 in the outer shell 40 is formed in alignment with the bore 38 in the inner core portion 34. The outer shell 40 can, as discussed above, be formed with dimples 44 therein so that the golf ball 10 has the "look-and-feel" of a traditional golf ball.

As will be apparent from the drawings, use of the golf ball 10 is rather simple. To illuminate the LEDs 14, 16, the plunger 36 merely has to be pulled or removed from the golf ball 10. When the plunger 36 is removed from the golf ball 10, the flexible connector 20 flexes downward (referring to the view of FIG. 3), thus making contact with the cathode (+) of the battery 18. This closes the electrical circuit 20, illuminating the LEDs 14, 16. A player can then play a round of golf. When it is desired to turn off or deenergize the LEDs 14, 16, the non-conductive plunger 36 is merely inserted into the ball 10 through the opening 42 in the outer shell 40 and through the bore 38, thus separating the flexible connector 22 from the battery 18. This opens the circuit 20 and deenergizes the LEDs 14, 16.

Advantageously, the present illuminated golf ball 10 provides a number of advantages over known illuminated golf balls. First, the integrally molded LEDs 14, 16 provide a substantial amount of light to locate the ball 10 along a fairway in the evening. Unlike known devices that, for example, use chemiluminescent light sticks, the present golf ball 10 emits a sufficiently bright light for a relatively prolonged period of time so that the ball can be located even in a relatively thick rough portion of a golf course. In addition, unlike some known "glow-in-the-dark" golf balls, the present golf ball 10, uses an internal battery 18, and thus does not require the storage of "energy" from an external light source. Those skilled in the art will recognize that some types of luminescent or phosphorescent devices require external light in order to store energy so that they can later emit that energy in the form of light. The present ball 10 uses an internal battery 18 to provide energy for illuminating the LEDs 14, 16.

In addition, it has been observed that known lighted golf balls such as those that use chemiluminescent light sticks can be improperly balanced or weighted due to the liquid light stick. This can adversely affect the flight of the ball, and can thus be a severe detriment, particularly to a serious golfer. The present illuminatable golf ball 10, on the other hand, has a substantially even weight distribution and center of gravity, and does not have a "moving" liquid central region. Thus, the present golf ball 10 has a "truer" flight that the known light golf balls.

It has also been observed that the present golf ball 10 can withstand severe and repeated impact and still maintain its ability to emit light. That is, after repeated impact by golf club heads as well as other impacts, the ability of the present golf ball 10 to emit light is not affected. Thus, it is anticipated that the useful, lighted life of the golf ball 10 will not be limited as a result of impact, but will more likely be limited by loss of the golf ball. Moreover, because of the plunger 36 "switch" arrangement, the LEDs 14, 16 can be deenergized or turned off so that the power from the battery 18 can be reserved for night time use of the ball 10. The present golf ball 10 also withstands other environmental conditions to which a traditional golf ball may be subjected. For example, the present golf ball 10 can be hit into a sand trap or into a water hazard without adversely affecting the ability of the ball 10 to emit light. That is, immersing the ball in water has not been shown to adversely affect the electrical circuit 20 and the ability of the LEDs 14, 16 to illuminate.

In the event that the golf ball 10 is kept until such time as the battery is drained and the LEDs 14, 16 no longer illuminate, the ball 10 can be used as just "another" golf ball to be used during daytime play. Those who play the game of golf will recognize that it is certainly desirable, if not necessary, to maintain a fairly substantial quantity of golf balls on hand when playing a round of golf. This is particularly true when playing on a challenging golf course.

An alternate embodiment 110 of the externally actuatable illuminated golf ball is illustrated in FIGS. 6–9. The alternate embodiment 110 is constructed in a similar fashion to the embodiment 10 of the golf ball illustrated in FIGS. 1–5, and includes a lighting device 112, a pair of lighting elements 114, 116, and a battery 118, defining an electrical circuit 120.

The ball 110 includes a pair of connectors 122, 124, at least one of which is flexible, and wires or leads 126, 128, 130, 132, extending between the connectors 122, 124 and the lighting elements 114, 116. The ball 110 is formed in a manner similar to the ball 10, having an inner core portion 134 and an outer shell portion 140. The core portion 134 has a bore therein 138 that is alignment with an opening 142 in the shell 140.

A plunger 136 is insertable into the ball 110 through the opening 142 and the bore 138. In this embodiment of the ball 110, one of the connectors, for example, connector 122 is positioned in the inner core portion 134, in spaced relation to the battery 118, when the plunger 136 is removed from the ball 110. That is, with the plunger 136 removed from the ball 110, the connector 122 and the battery 118 are not electrically connected, the electrical circuit 120 is open (i.e., deenergized), and thus the elements 114, 116 are not lit.

When the plunger 136 is inserted into the ball 110, it provides an electrical connection between the batter 118 and the connector 122, thus completing the circuit 120.

It will be apparent from the drawings and the present description, that the plunger 136 is formed of, at least in part, an electrically conductive material. In one contemplated arrangement, the plunger 136 remains in the ball 110 once it is positioned therein, and the ball 110 remains lit once it is activated. In another contemplated arrangement, the plunger 136 is subsequently removable from the ball to deenergize the lighting circuit 120.

Figure 11:
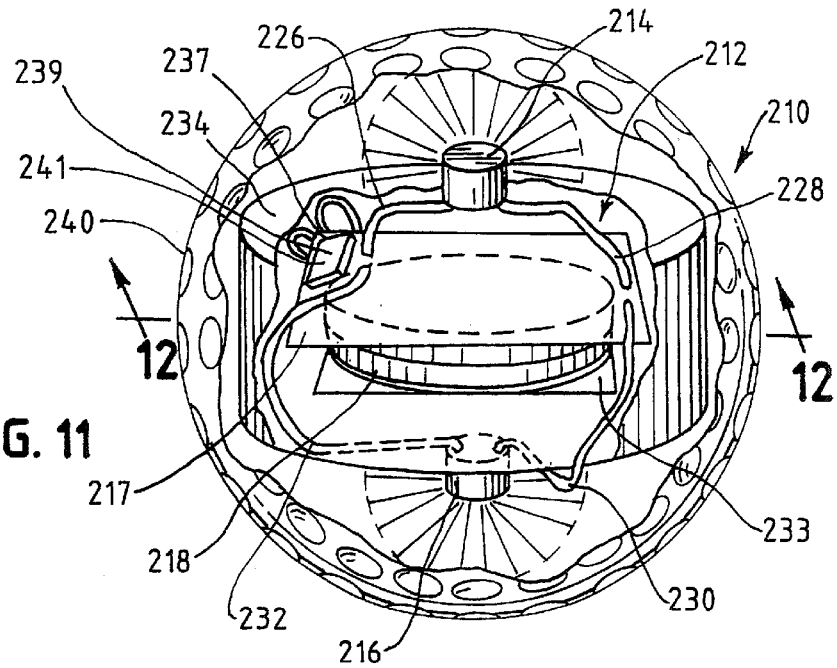
FIG. 11 is a partially broken away perspective view similar to FIG. 1 illustrating an embodiment of the illuminated golf ball having a lighting device that is actuatable by shock or force exerted on the ball.
Figure 12:
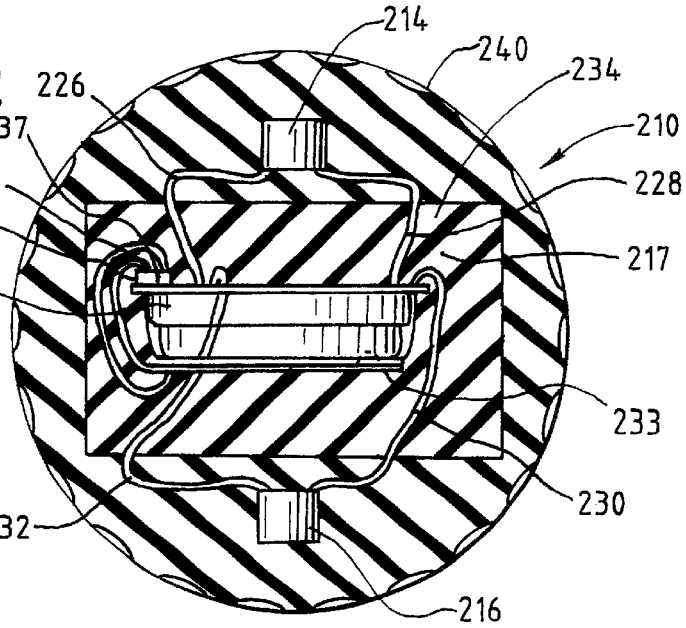
FIG. 12 is a cross-sectional view of the golf ball of FIG. 11 taken along line 12—12 of FIG. 11.
Figure 13:
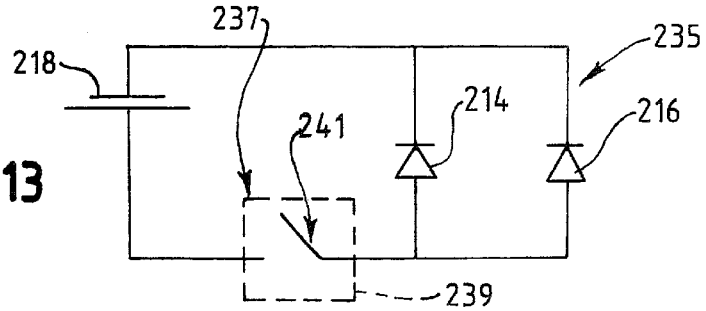
FIG. 13 is a simplified circuit diagram of the illuminating device of the golf ball of FIGS. 11 and 12.

Still another embodiment 210 of the illuminated golf ball is illustrated in FIGS. 11–13. In this embodiment, the lighting device 212 is completely self-contained and does not require an external actuation element such as the plunger 36, 136 illustrated in the previous embodiments 10, 110. In this embodiment of the golf ball 210, the lighting device 212 includes an energy source such as the illustrated battery 218, lighting elements, such as the illustrated LEDs 214, 216, a circuit board 217 to which the LEDs 214, 216 are connected by leads 226, 228, 230, 232, a conductor plate 233 to complete the electrical circuit between the battery 218 and the LEDs 214, 216. The lighting device 212 further includes control circuitry 235 that be incorporated into a controller 237 that includes a shaker or otherwise force-actuatable switch 239. As will be recognized by those skilled in the art, the switch 239 changes state from the deenergized state to the energized state by the application of force on the switch 239. This can be in the form of an impact, such as when the ball 210 is struck by a golf club or the like.

The control circuitry 235 and switch 239 have associated therewith a timer 241 that can be incorporated into the controller 237. The timer 241 maintains the circuit in the energized state after actuation for a predetermined time. In an anticipated embodiment, the timer 241 maintains the circuit energized for a period of between about five and about nine minutes, so that the LEDs 214, 216 remain illuminated for this predetermined period of time. The inner core portion 234 of the ball 212, as well as the outer shell 240 are otherwise similar to the embodiments 10, 110 of the ball illustrated in FIGS. 1–10.

In use, the ball 210 merely needs to be hit or otherwise jarred sufficiently to close the switch 239 and energize the circuitry 235. The timer 241 functions to deenergize the circuitry 235 upon expiration of the predetermined period of time. In this manner, the battery 218 power is reserved during non-lighted periods. In this embodiment of the ball 210, the circuitry 235, including the switch 239 is impact-resistant once the switch 239 is closed and/or the circuitry is in the energized state.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. An illuminatable golf ball comprising:

an outer translucent shell having an opening therein;

an inner core portion surrounded by the outer shell, the inner core having a bore therein in alignment with the opening in the outer shell;

a self-contained lighting device contained at least in part within the inner core portion, the lighting device including a battery, at least one lighting element, and at least two connectors extending between the battery and the at least one lighting element defining an electrical circuit having a deenergized state and an energized state for providing electrical energy from the battery to the at least one lighting device, at least one of the connectors being flexible and separable from the battery, at least a portion of the at least one flexible connector being positioned within the inner core bore; and a plunger configured for insertion into the bore, wherein when the plunger is inserted into the bore between the battery and the at least one connector separating the battery and at least one flexible connector, the plunger intermediately contacts the battery and at least one flexible connector changing the state of the electrical circuit from one of the energized state to the deenergized state or the deenergized state to the energized state.

2. The illuminatable golf ball in accordance with claim 1 wherein the plunger is at least in part electrically non-conductive and wherein when the plunger is removed from the bore, the at least one flexible connector contacts the energy source and closes the electrical circuit to change the state of the circuit from the deenergized state to the energized state.

3. The illuminatable golf ball in accordance with claim 1 wherein the plunger is at least in part electrically conductive and wherein when the plunger is inserted into the bore, the plunger, completes the electrical circuit to change the state of the electrical circuit from the deenergized state to the energized state.

4. The illuminatable golf ball in accordance with claim 1 wherein the energy source is a battery.

5. The illuminatable golf ball in accordance with claim 4 wherein the battery is a button-type battery.

6. The illuminatable golf ball in accordance with claim 1 wherein the lighting device includes two lighting elements and wherein the lighting device includes two connectors, at least one of the connectors being a flexible connector that is positioned adjacent to and separable from the energy source.

7. The illuminatable golf ball in accordance with claim 2 wherein the entirety of the plunger is formed of an electrically non-conductive material.

8. The illuminatable golf ball in accordance with claim 3 wherein the entirety of the plunger is formed of an electrically conductive material.

9. The illuminatable golf ball in accordance with claim 1 wherein the inner core portion is formed of polyurethane.

10. The illuminatable golf ball in accordance with claim 1 wherein the outer shell is formed of polyurethane.

11. The illuminatable golf ball in accordance with claim 1 wherein the outer shell is formed with dimples.

12. The illuminatable golf ball in accordance with claim 6 wherein the two lighting elements are connected in the electrical circuit in parallel.

13. A method for making an illuminatable golf ball comprising the steps of:

positioning a battery, at least one lighting element, and at least two connectors relative to one another such that the at least two connectors extend between the battery and the at least one lighting element to define an electrical circuit having a deenergized state and an energized state for providing electrical energy from the battery to the at least one lighting device, at least one of the connectors being flexible and separable from the battery;

positioning a plunger between the flexible connector and the battery in separating intermediate contact with the flexible connector and battery;

forming an inner core portion around the electrical lighting device such that the battery, the at least two connectors, and a portion of the lighting element are within the inner core portion; and forming an outer translucent shell around the inner core portion so as to envelope the inner core portion.

14. The method for making an illuminatable golf ball in accordance with claim 13 including positioning the connectors so as to rest on the energy source.

15. The method for making an illuminatable golf ball in accordance with claim 13 including positioning one of the connectors in spaced relation to the energy source.

* * * * *